US007636950B2

(12) United States Patent
Melhart et al.

(10) Patent No.: US 7,636,950 B2
(45) Date of Patent: Dec. 29, 2009

(54) ARTICLE OF APPAREL WITH ZONAL STRETCH RESISTANCE

(75) Inventors: James Hal Melhart, Beaverton, OR (US); David Turner, Portland, OR (US)

(73) Assignee: Nike, Inc., Beaverton, OR (US)

( * ) Notice: Subject to any disclaimer, the term of this patent is extended or adjusted under 35 U.S.C. 154(b) by 568 days.

(21) Appl. No.: 11/241,793

(22) Filed: Sep. 30, 2005

(65) Prior Publication Data

US 2007/0074328 A1 Apr. 5, 2007

(51) Int. Cl.
*A41D 13/00* (2006.01)
*A41B 1/00* (2006.01)

(52) U.S. Cl. ..... 2/69; 2/115

(58) Field of Classification Search ..... 2/16, 2/125, 115, 69
See application file for complete search history.

(56) References Cited

U.S. PATENT DOCUMENTS 1,329,025 A * 1/1920 Smith ..... 66/175
1,561,400 A * 11/1925 Begg ..... 128/881
3,322,118 A * 5/1967 Sotherlin ..... 128/892
4,688,269 A * 8/1987 Maeshima ..... 2/456
4,722,099 A * 2/1988 Kratz ..... 2/79
4,728,538 A * 3/1988 Kaspar et al. ..... 427/288
4,783,858 A * 11/1988 Chevalier ..... 2/90
4,843,646 A * 7/1989 Grilliot et al. ..... 2/69
5,035,001 A 7/1991 Novick
5,105,478 A * 4/1992 Pyc ..... 2/115
5,210,877 A * 5/1993 Newman ..... 2/456
5,282,277 A * 2/1994 Onozawa ..... 2/69
5,354,339 A 10/1994 Bodnar
5,469,581 A 11/1995 Uthoff
5,638,546 A * 6/1997 Vita ..... 2/16
6,047,406 A * 4/2000 Dicker et al. ..... 2/69
6,279,161 B1 * 8/2001 Johnston ..... 2/69

(Continued)

FOREIGN PATENT DOCUMENTS

DE 10358146 A1 7/2005

(Continued)

OTHER PUBLICATIONS

International Search Report dated Feb. 6, 2007 in Application No. PCT/US2006/036053.

(Continued)

*Primary Examiner*—Alissa L Hoey
(74) *Attorney, Agent, or Firm*—Banner & Witcoff, Ltd.

(57) ABSTRACT

Various articles of apparel having a cylindrical portion, such as an arm region or a leg region, for extending around a joint (such as an elbow or a knee) of a wearer are disclosed. The cylindrical portion includes a textile material, for example, and a pattern located on a surface of the textile material or knitted into the textile material. The pattern has a first density in at least one area of the cylindrical portion oriented substantially parallel to a plane of bending of the joint, and the pattern has a second density in at least one area of the cylindrical portion oriented substantially perpendicular to the plane of bending of the joint. A purpose of the pattern may be to decrease the probability of an overuse syndrome or other injury occurring as a result of use of the joint.

5 Claims, 14 Drawing Sheets

U.S. PATENT DOCUMENTS

| | | | | |
|---|---|---|---|---|
| 6,353,934 | B1 * | 3/2002 | Tada et al. | 2/115 |
| 6,465,073 | B1 | 10/2002 | Morman et al. | |
| 6,892,396 | B2 * | 5/2005 | Uno et al. | 2/115 |
| 38,838 | A1 * | 1/2006 | Foreman et al. | 2/115 |
| 6,996,848 | B2 * | 2/2006 | Donaldson | 2/16 |
| 39,264 | A1 * | 1/2007 | MacDonald et al. | 2/69 |
| 7,428,772 | B2 * | 9/2008 | Rock | 28/159 |
| 2003/0041364 | A1 | 3/2003 | Donaldson | |
| 2004/0078865 | A1 * | 4/2004 | Culhane | 2/69 |
| 2005/0114978 | A1 * | 6/2005 | Benini | 2/69 |
| 2005/0246813 | A1 * | 11/2005 | Davis et al. | 2/69 |
| 2006/0053526 | A1 * | 3/2006 | Beland et al. | 2/115 |
| 2006/0070165 | A1 * | 4/2006 | Nordt et al. | 2/69 |
| 2006/0143772 | A1 * | 7/2006 | Feduzi et al. | 2/69 |
| 2006/0179539 | A1 * | 8/2006 | Harber | 2/69 |
| 2006/0200890 | A1 * | 9/2006 | Prat Gonzalez | 2/69 |
| 2006/0272071 | A1 * | 12/2006 | Mickle | 2/69 |
| 2007/0000010 | A1 * | 1/2007 | Benini | 2/69 |
| 2007/0113315 | A1 * | 5/2007 | Reynolds | 2/69 |
| 2007/0204378 | A1 * | 9/2007 | Behar | 2/69 |
| 2007/0214540 | A1 * | 9/2007 | Bedard et al. | 2/69 |
| 2007/0271671 | A1 * | 11/2007 | Okajima | 2/69 |
| 2008/0229473 | A1 * | 9/2008 | Baron et al. | 2/106 |

FOREIGN PATENT DOCUMENTS

| | | | |
|---|---|---|---|
| EP | 0498062 | A1 | 8/1992 |
| WO | 0051537 | A | 9/2000 |

OTHER PUBLICATIONS

Written Opinion of International Searching Authority in Application No. PCT/US2006/036053.

International Preliminary Report on Patentability mailed Apr. 10, 2008 in Application No. PCT/US2006/036053.

* cited by examiner

ARTICLE OF APPAREL WITH ZONAL STRETCH RESISTANCE

BACKGROUND

Pitching or otherwise throwing a baseball involves a coordinated body movement culminating in straightening the elbow joint as the baseball is released from the hand. More specifically, pitching involves four general phases: wind-up, cocking, acceleration, and follow-through. The wind-up and cocking phases involve bending the elbow joint and rotating the shoulder backward in preparation for propelling the baseball in a forward direction. During acceleration, the shoulder rotates forward while simultaneously straightening the elbow joint in order to accelerate the baseball. Once the baseball has achieved sufficient velocity, the baseball is released from the hand and flies in the forward direction. The pitcher then follows-through on the pitch, which may involve further extension of the elbow joint.

During both the acceleration and follow-through phases, a relatively large extension and valgus load may be placed on the elbow joint. More particularly, valgus stress may be placed on the elbow joint during the acceleration phase. Tensile forces that result from the valgus stress may cause injury to the flexor musculature, injury to the medial collateral ligaments, avulsion fractures of the medial epicondyles, and traction spurs of the ulnar coronoid, for example. Compressive forces associated with the acceleration phase may also result in osteochondral fracture of the capitellum, osteochondritis dissecans, deformity of the radial head, lateral epicondylitiss, and lateral collateral ligament sprain, for example. During the follow-through phase of the throwing motion, the triceps muscle forcefully extends the elbow, which may develop tensile forces along the length of the muscle-tendon unit. These forces may result, for example, in olecranon avulsion fractures, triceps strains, olecranon spurs, and joint degeneration.

Although the specific motions necessary to properly throw a fastball, curveball, and knuckleball, for example, may vary significantly, repeatedly pitching a baseball during practice or competition induces stresses in the elbow joint. As the number of pitches increases during a particular game, practice session, or over the course of a season, the repeated application of stresses to the elbow joint may lead to overuse syndromes of the elbow joint.

SUMMARY

One aspect of the invention is an article of apparel having a cylindrical portion, such as an arm region or a leg region, for extending around a joint of a wearer. The cylindrical portion includes a textile material and a pattern located on a surface of the textile material. The pattern has a first density in at least one area of the cylindrical portion oriented substantially parallel to a plane of bending of the joint, and the pattern has a second density in at least one area of the cylindrical portion oriented substantially perpendicular to the plane of bending of the joint.

Another aspect of the invention is an article of apparel having a torso region and a pair of arm regions. At least one of the arm regions has an elbow portion for extending around an elbow joint of a wearer, and the elbow portion includes a pair of first areas and a pair of second areas. The first areas are oriented substantially parallel to a plane of bending of the elbow joint and located on opposite sides of the elbow portion, and the first areas have a first degree of stretch resistance in a direction extending around the elbow portion. The second areas are oriented substantially perpendicular to the plane of bending of the elbow joint and located on opposite sides of the elbow portion, and the second areas have a second degree of stretch resistance in the direction extending around the elbow portion. The first degree of stretch resistance may be less than the second degree of stretch resistance.

The advantages and features of novelty characterizing various aspects of the invention are pointed out with particularity in the appended claims. To gain an improved understanding of the advantages and features of novelty, however, reference may be made to the following descriptive matter and accompanying drawings that describe and illustrate various embodiments and concepts related to the aspects of the invention.

DESCRIPTION OF THE DRAWINGS

The foregoing Summary, as well as the following Detailed Description, will be better understood when read in conjunction with the accompanying drawings.

DETAILED DESCRIPTION

The following material and accompanying figures discloses various articles of apparel with zonal stretch resistance. As discussed in the Background section above, pitching or otherwise throwing a baseball involves a coordinated body movement culminating in straightening the elbow joint as the baseball is released from the hand. Repeatedly pitching a baseball during practice or competition induces stresses in the elbow joint that may result in overuse syndromes of the elbow joint. The various articles of apparel discussed below incorporate features that may decrease the probability of an overuse syndrome or other injury occurring as a result of pitching a baseball.

Figure 1:
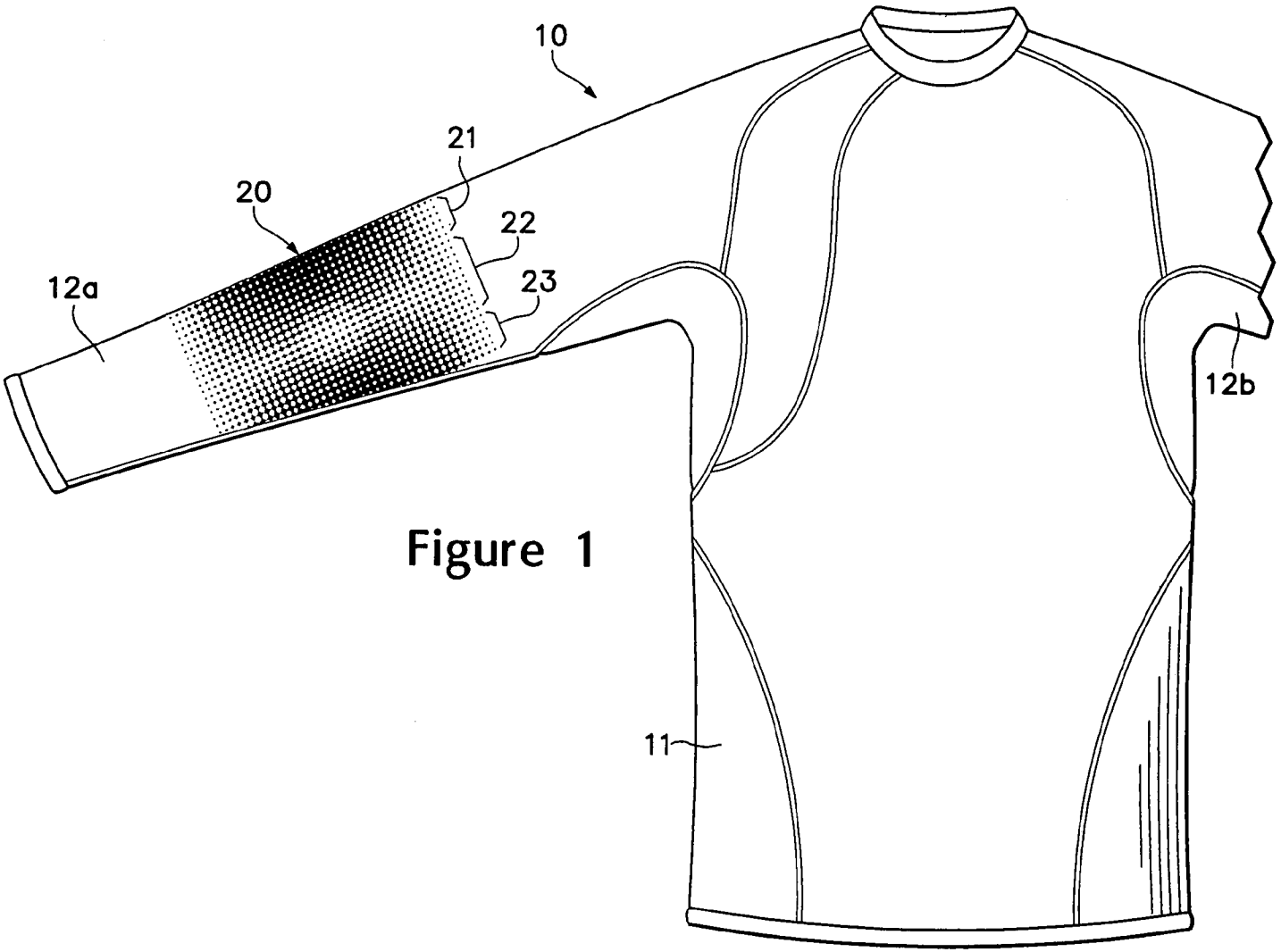
FIG. 1 is a front elevational view of a first article of apparel in accordance with aspects of the present invention.
Figure 2:
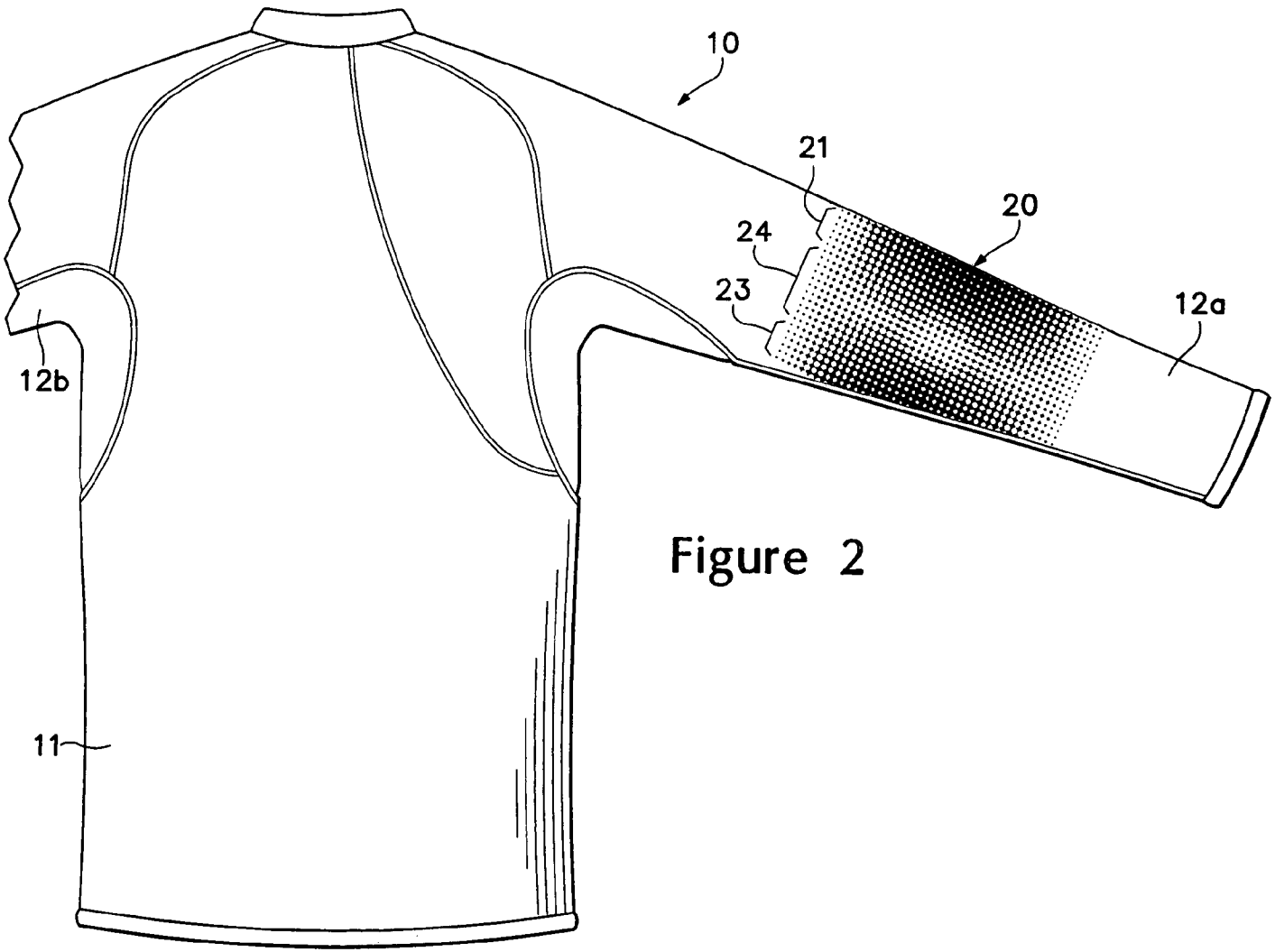
FIG. 2 is a back elevational view of the first article of apparel.

An article of apparel 10 is depicted in FIGS. 1 and 2 as having the general configuration of a long-sleeved shirt. Apparel 10 includes a torso region 11 and a pair of arm regions 12*a* and 12*b*. Torso region 11 corresponds with a torso of an individual and, therefore, covers the torso when worn. Arm regions 12*a* and 12*b* respectively correspond with a right arm and a left arm of the individual and, therefore, cover the right arm and the left arm when worn.

Arm region 12*a* incorporates a pattern 20 that imparts zonal stretch resistance and may decrease the probability of an overuse syndrome or other injury developing in the right arm as a result of throwing a baseball. Statistically, the right arm is most likely to be a throwing arm of the individual. Accordingly, the following discussion proceeds upon the basis that arm region 12*a* corresponds with the throwing arm. If an article of apparel similar to apparel 10 is manufactured for an individual with a left arm as the throwing arm, however, the various features discussed herein for arm region 12*a* may be incorporated into arm region 12*b*.

Pattern 20 is positioned around an elbow portion of arm region 12*a* and is structured to impart stretch resistance in zones that extend around the elbow joint of the individual. As discussed in greater detail below, pattern 20 may be formed from a material that is applied to a surface of a textile material forming arm region 12*a* (e.g., through a printing process). In general, the degree of stretch resistance provided by pattern 20 is directly related to the density of the material forming pattern 20 in a particular area. Accordingly, areas of arm region 12*a* where a greater quantity of the material forming pattern 20 is present will generally exhibit greater stretch resistance, and areas of arm region 12*a* where a lesser quantity of the material forming pattern 20 is present will generally exhibit lesser stretch resistance. By varying the density of the material forming pattern 20 in particular zones, therefore, the stretch resistance of arm region 12*a* in those particular zones may be controlled or otherwise selected.

As utilized herein, the term "density" is intended to refer to the quantity of pattern 20 per unit area. Accordingly, areas where a relatively large quantity of pattern 20 is present will have greater density than areas where a relatively small quantity of pattern 20 is present.

Figure 3:
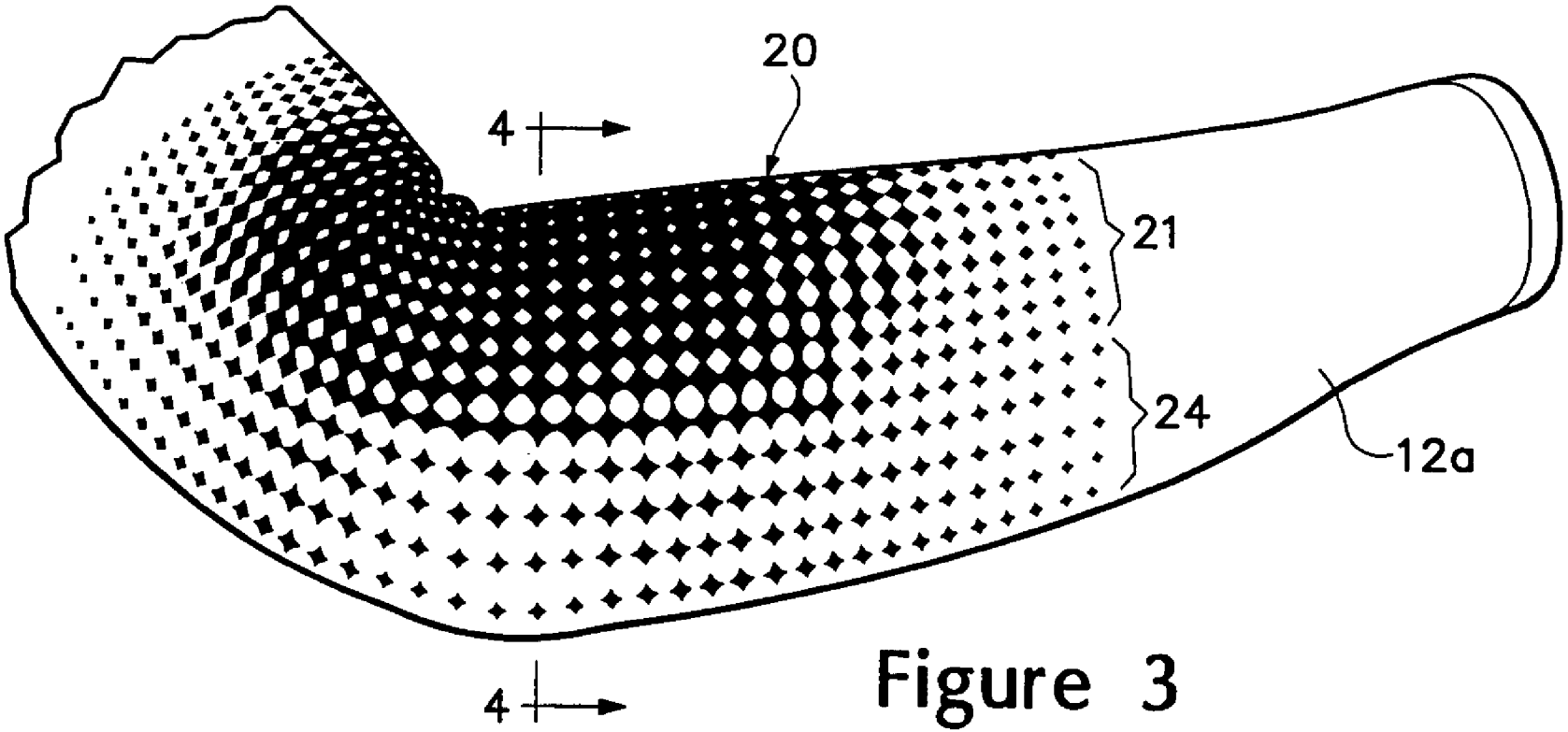
FIG. 3 is a perspective view of the arm region of the first article of apparel in a flexed configuration.

With reference to FIG. 3, the elbow portion of arm region 12*a* is depicted as having a flexed configuration. More particularly, the elbow portion is depicted as if an elbow joint of the individual, which is received by arm region 12*a*, were flexed at an approximate ninety degree angle. During bending of the elbow joint, the lower arm (i.e., portion of the arm between the elbow joint and the wrist) moves relative to the upper arm (i.e., portion of the arm between the shoulder and the elbow joint) to define a plane of bending. The orientation of the plane of bending may vary depending upon the position of the arm, but both the lower arm and the upper arm generally lie along the plane of bending regardless of the position of the arm relative the body of the individual. Accordingly, the plane of bending effectively represents a plane that is parallel to a plane along which the lower arm moves during bending at the elbow joint.

As noted above, pattern 20 is structured to impart stretch resistance in zones that extend around the elbow joint of the individual. In general, the zones of pattern 20 impart greater stretch resistance in areas that are substantially parallel to the plane of bending, and the zones of pattern 20 impart lesser stretch resistance in areas that are substantially perpendicular to the plane of bending. Furthermore, the degree of stretch resistance provided by pattern 20 is directly related to the density of pattern 20 in a particular area. Accordingly, the different zones of pattern 20, which have different degrees of stretch resistance, may be formed by differences in the density of pattern 20.

The position and orientation of the different zones of pattern 20 will now be discussed in greater detail. With reference to FIGS. 1-4, pattern 20 includes four general stretch resistance zones that include a first zone 21, a second zone 22, a third zone 23, and a fourth zone 24. Each of zones 21-24 are positioned in the elbow portion of arm region 12*a* and extend sequentially around arm region 12*a*. Although zones 21-24 are depicted as being generally limited to an area around the elbow portion of arm region 12*a*, zones 21-24 may extend to the shoulder portion and wrist portion of arm region 12*a* in some embodiments.

Zones 21 and 23 are respectively located on an upper area and a lower area of the throwing arm and include areas that are substantially parallel to the plane of bending. In addition, zones 21 and 23 encompass areas of pattern 20 with a relatively high density of material that forms pattern 20. Accordingly, zones 21 and 23 form areas of higher stretch resistance that are oriented substantially parallel to the plane of bending. Zones 22 and 24 are respectively located on opposite sides of the throwing arm and include areas that are substantially perpendicular to the plane of bending. In addition, zones 22 and 24 encompass areas of pattern 20 with a relatively low density of material that forms pattern 20. Accordingly, zones 22 and 24 form areas of lower stretch resistance that are oriented substantially perpendicular to the plane of bending.

Based upon the above discussion, differences between zones 21 and 23 and zones 22 and 24 include the orientation relative to the plane of bending and stretch resistance. As a comparison, zones 21 and 23 exhibit a) areas with an orientation that is substantially parallel to the plane of bending and b) relatively high stretch resistance, whereas zones 22 and 24 exhibit a) areas with an orientation that is substantially perpendicular to the plane of bending and b) relatively low stretch resistance.

Zones 21 and 23 are discussed above as including areas that are substantially parallel to the plane of bending. Similarly, zones 22 and 24 are discussed above as including areas that are substantially perpendicular to the plane of bending. Zones 21-24 each have a curved configuration when extending around the throwing arm and, therefore, only a relatively small portion of zones 21-24 are truly parallel or perpendicular to the plane of bending in a strict mathematical sense. Zones 21-24 and areas of zones 12-24 are discussed, however, as being "substantially parallel" and "substantially perpendicular" to the plane of bending. Accordingly, zones 21-24 may deviate from being parallel and perpendicular (in the strict mathematical sense) by forty-five degrees, for example, and remain "substantially parallel" and "substantially perpendicular" to the plane of bending. Use of the terms "substantially parallel" and "substantially perpendicular" is intended, therefore, to allow for deviations from the strict mathematical definition of parallel and perpendicular.

Athletes conventionally utilize wraps on joints that may be injured or susceptible to injury. In general, the wraps extend around the joints and place a substantially uniform pressure upon muscles, ligaments, and tendons forming the joint, and the wraps exhibit substantially uniform stretch resistance around the joint. Pattern 20, however, imparts zonal stretch resistance. That is, pattern 20 imparts greater stretch resistance to zones 21 and 23 and lesser stretch resistance to zones 22 and 24. In contrast with the conventional wraps, therefore, pattern 20 may place pressure upon selected locations around the elbow joint. During pitching or otherwise throwing a baseball, increased flexibility or mobility of the arm provides the individual with an enhanced ability to accurately and quickly accelerate the baseball toward the batter. Whereas the conventional wraps may restrict the flexibility and mobility of the throwing arm, pattern 20 permits a generally full range of motion in the throwing arm while also decreasing the probability of an overuse syndrome or other injury occurring as a result of pitching a baseball. Pattern 20 also provides apparel 10 with a unique aesthetic.

Figure 4:
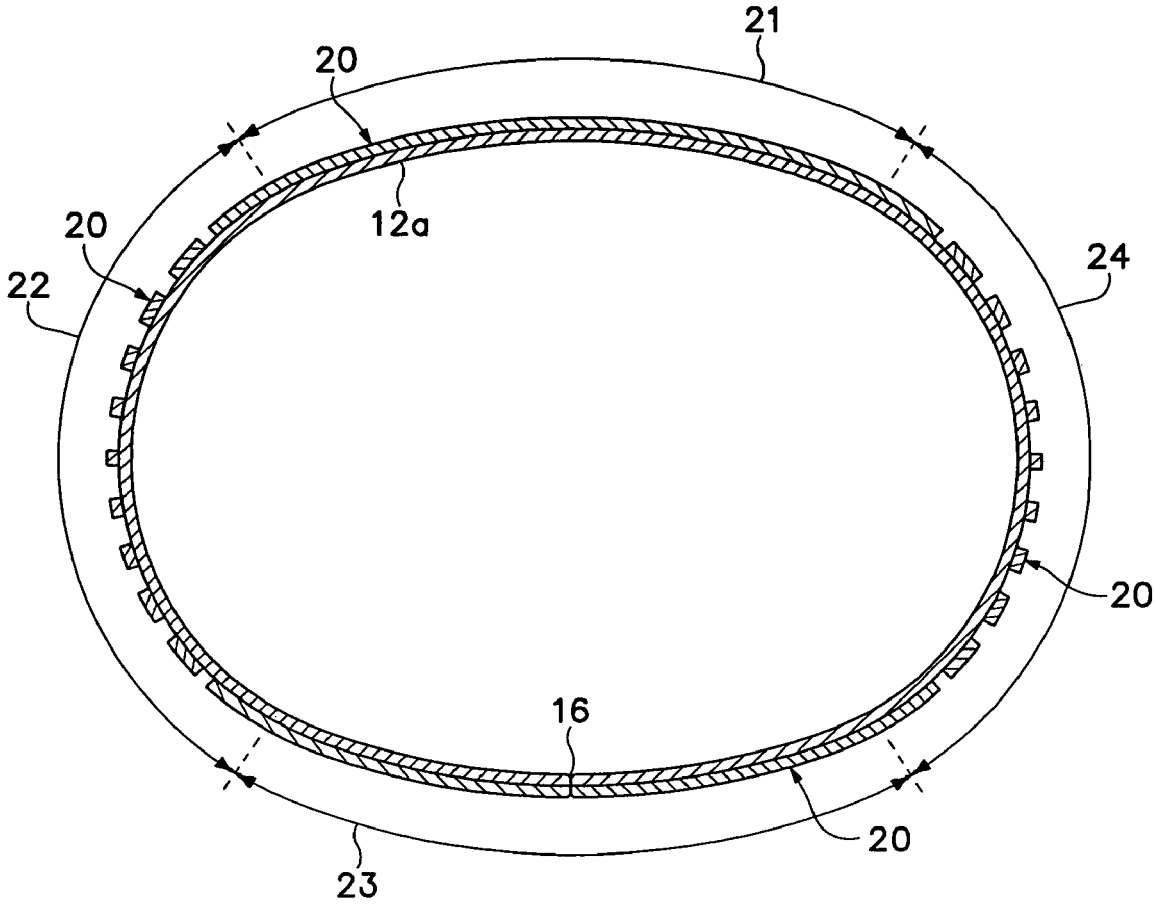
FIG. 4 is a cross-sectional view of the arm region of the first article of apparel, as defined by line 4-4 in FIG. 3.
Figure 5:
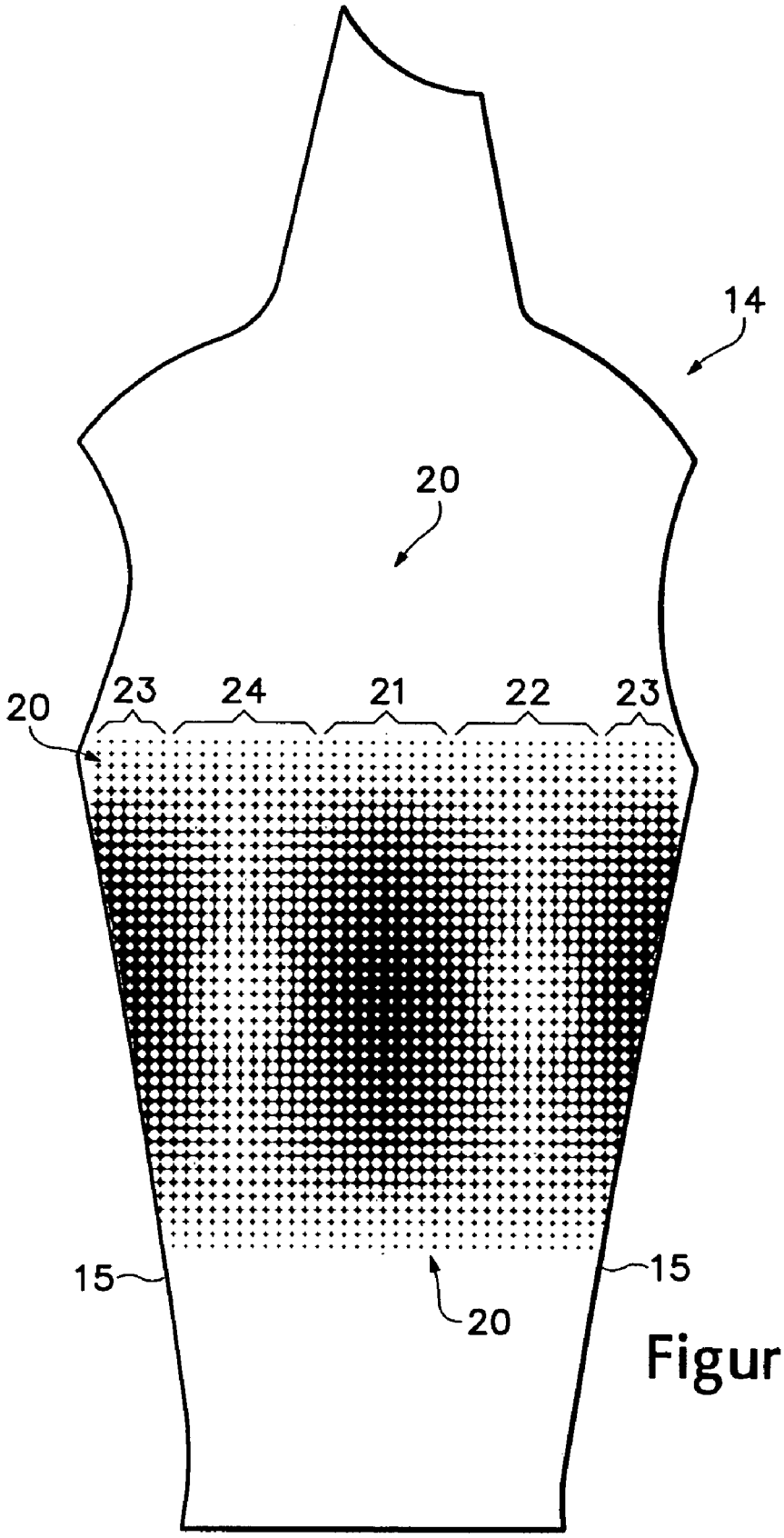
FIG. 5 is plan view of a material element forming the arm region of the first article of apparel.

A variety of manufacturing techniques may be utilized to form pattern 20. As depicted in FIG. 4, arm region 12*a* is formed from a textile material, and pattern 20 is a separate material applied to a surface of the textile material. More particularly, the material of pattern 20 may be applied to a surface of a material element 14 forming arm region 12*a*, as depicted in FIG. 5, and material element 14 may then be incorporated into apparel 10. Material element 14 includes a pair of opposing edges 15 that are placed adjacent to each other to form a generally cylindrical structure that becomes arm region 12*a*. In forming arm region 12*a*, edges 15 are sewed or otherwise joined to define a seam 16. Various screen-printing processes, heat transfer processes, molding processes, and adhesive processes may be utilized to apply the material of pattern 20 to material element 14. Accordingly, a variety of techniques may be utilized to form pattern 20 or other patterns that impart zones of stretch.

Figure 6:
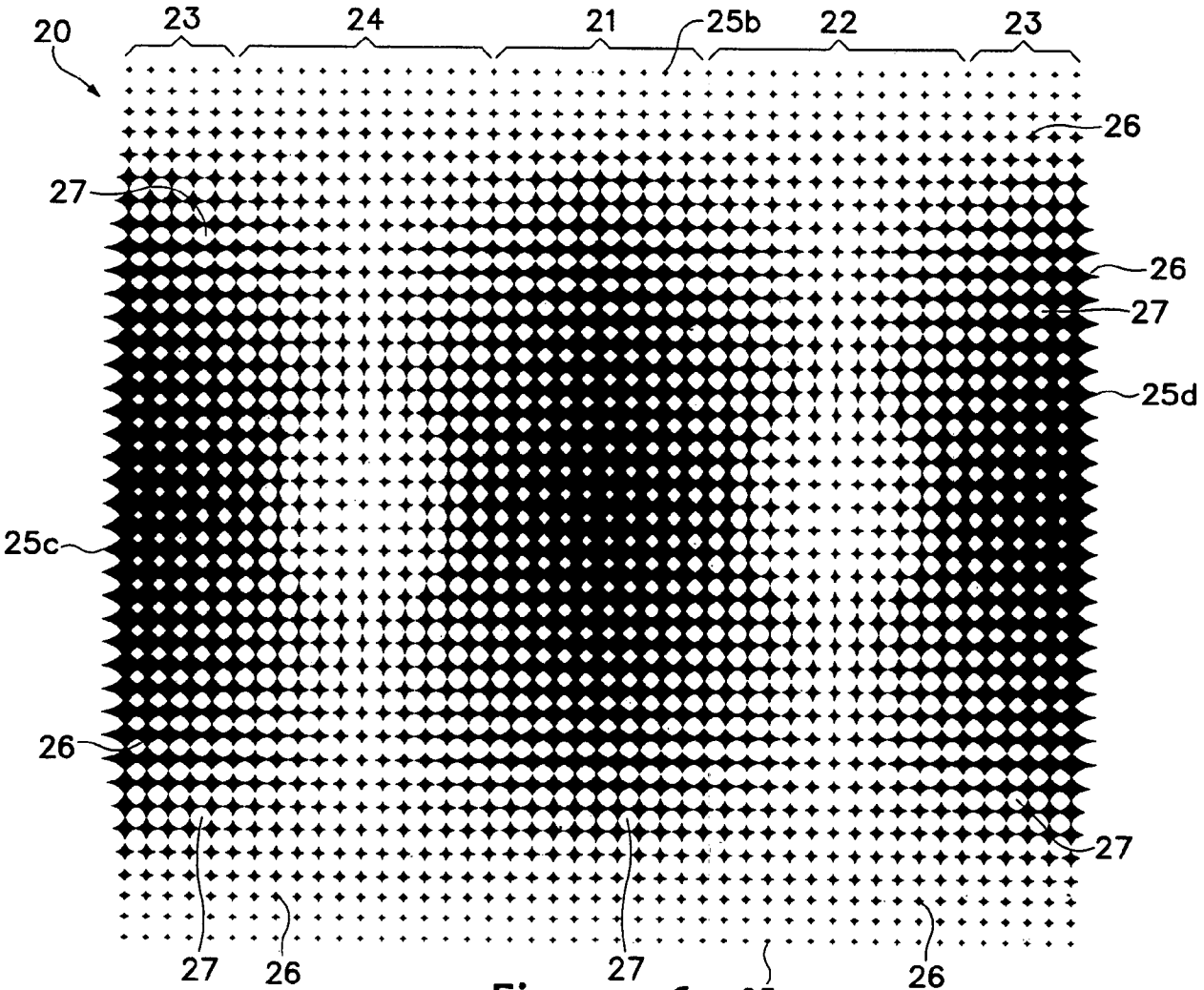
FIG. 6 is a plan view of a pattern applied to the arm region of the first article of apparel.

Pattern 20 is depicted individually in FIG. 6 with zones 21-24 and four edges 25*a*-25*d* identified for reference. When incorporated into arm region 12*a*, edge 25*a* is positioned closest to the wrist, edge 25*b* is positioned closest to the shoulder, and edges 25*c* and 25*d* are positioned adjacent to each other and adjacent seam 16 in arm region 12*a*. Although the overall density of pattern 20 is greater in zones 21 and 23 than in zones 22 and 24, the density changes gradually or in a spectrum-like fashion in a direction between edges 25*c* and 25*d*. In addition, the density of each of zones 21-24 decreases as zones 21-24 approach edges 25*a* and 25*b*.

Pattern 20 is effectively formed from a plurality of generally diamond-shaped elements 26 of varying size. More particularly, elements 26 have four sides of approximately equal length, and the sides are curved inward. In central areas of zones 22 and 24, for example, elements 26 are discrete or otherwise separate from each other such that the textile material forming arm region 12*a* extends between the various elements 26. Similarly, elements 26 are separate from each other in the portions of zones 21-24 adjacent to each of edges 25*a* and 25*b*. In central areas of zones 21 and 23, however, elements 26 have sufficient size to overlap each other and define various apertures 27 that expose portions of the textile material forming arm region 12*a*.

The size of elements 26 changes throughout zones 21-24 so as to change the relative area of the textile material of arm region 12*a* that is covered by pattern 20 and exposed in between portions of pattern 20. More particularly, a size of elements 26 increases as a position of elements 26 approaches central areas of zones 21 and 23. This increase in the size of elements 26 effectively decreases the size of apertures 27 in the central areas of zones 21 and 23. Similarly, a size of elements 26 decreases as a position of elements 26 approaches central areas of zones 22 and 24.

In areas where elements 26 define discrete portions of pattern 20, the textile material of arm region 12*a* is permitted to stretch without significant hindrance from pattern 20. In areas where elements 26 define apertures 27, however, the textile material of arm region 12*a* is restricted from stretching to a greater degree, thereby imparting greater stretch resistance. Accordingly, areas of arm region 12*a* that are exposed by pattern 20 exhibit lesser stretch resistance, and areas that are covered by pattern 20 exhibit greater stretch resistance. Given that the density of pattern 20 may change gradually or in a spectrum-like fashion, as discussed above, the stretch resistance of arm region 12*a* may change in a corresponding manner.

Figure 7A:
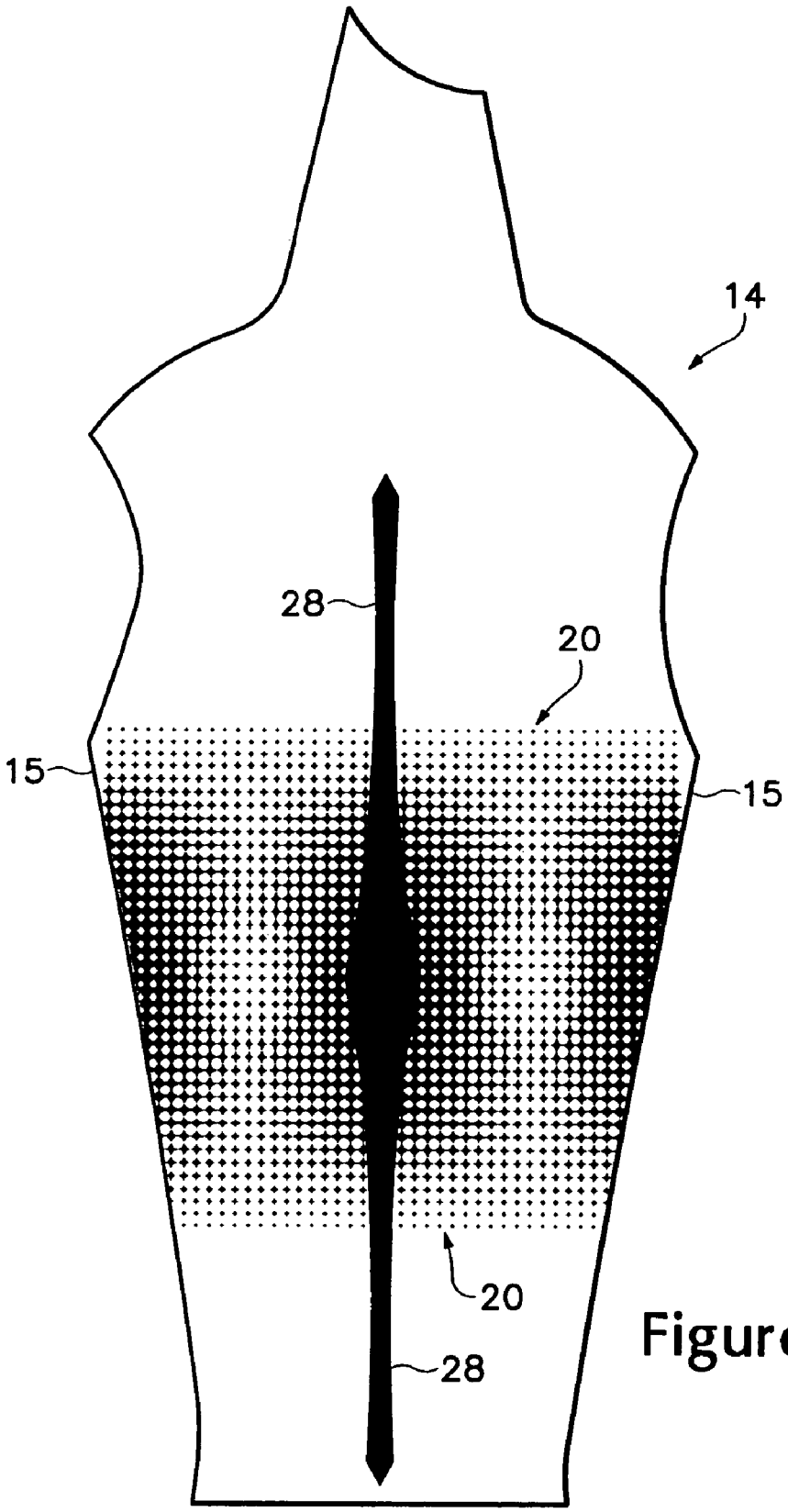
FIG. 7A is a plan view of a first alternate material element.
Figure 7B:
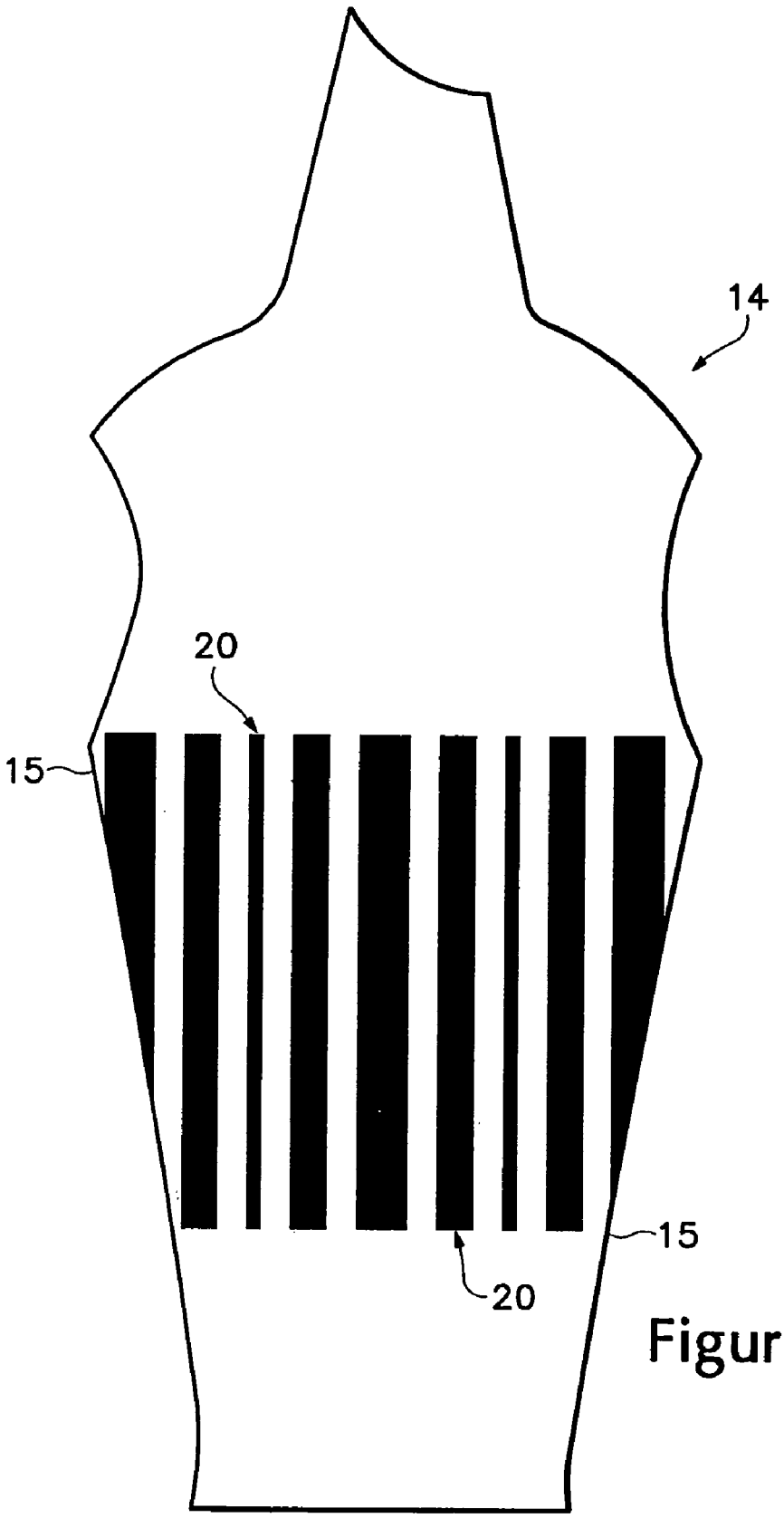
FIG. 7B is a plan view of a second alternate material element.
Figure 7C:
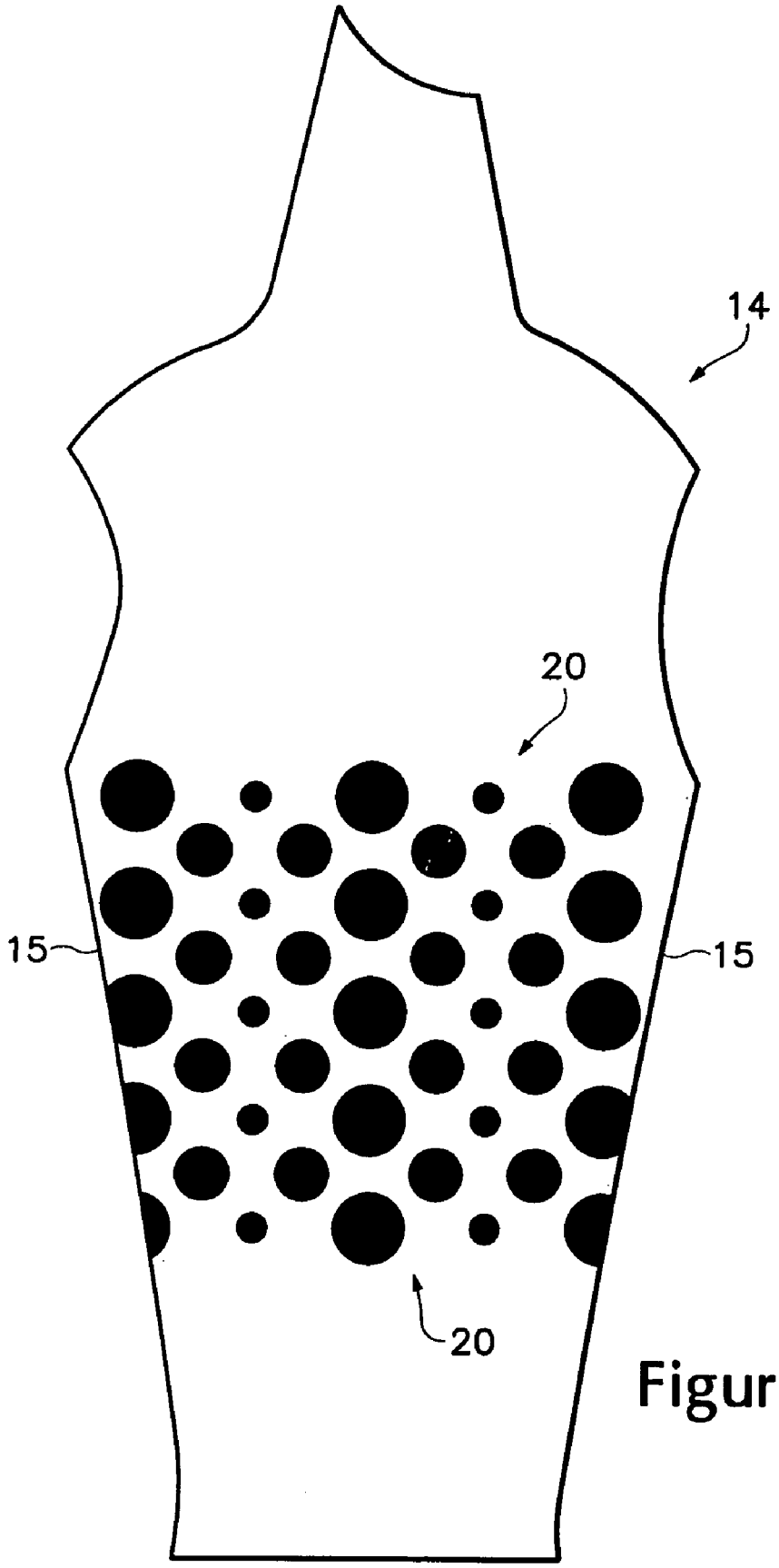
FIG. 7C is a plan view of a third alternate material element.
Figure 7D:
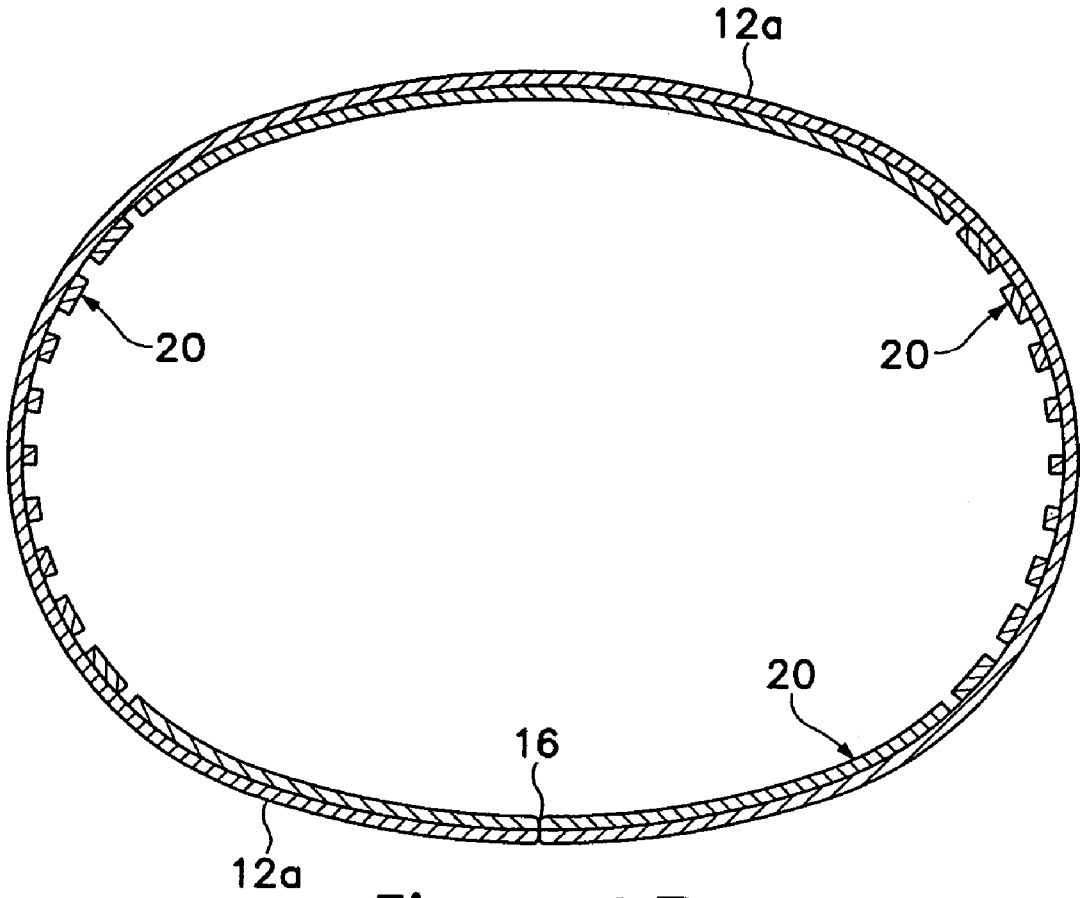
FIG. 7D is an first alternate cross-sectional view of the arm region corresponding with FIG. 4.
Figure 7E:
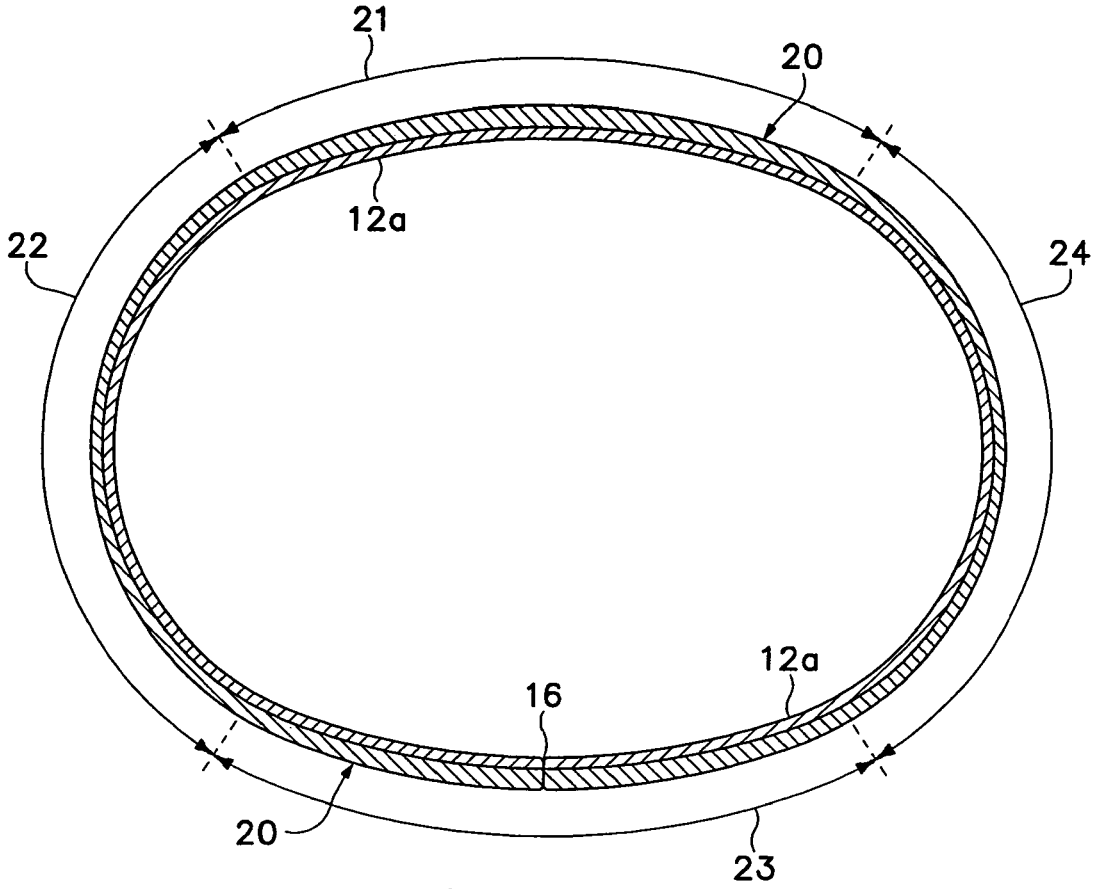
FIG. 7E is a second alternate cross-sectional view of the arm region corresponding with FIG. 4.

Although pattern 20, as depicted in FIGS. 1-6, is sufficient to impart zonal stretch resistance to apparel 10, a variety of other configurations may also be utilized. For example, FIG. 7A depicts pattern 20 as including a stripe 28. Whereas the central area of zone 21 generally includes various apertures 27, stripe 28 further increases the stretch resistance by reducing the number of apertures. A plurality of stripes, as depicted in FIG. 7B, may also be utilized as pattern 20. In general, thicker stripes will impart greater stretch resistance, whereas thinner stripes will impart lesser stretch resistance. Accordingly, thicker stripes are positioned in areas corresponding with zones 21 and 23, and thinner stripes are positioned in areas corresponding with zones 22 and 24. A similar configuration may be formed by discrete circular elements, as depicted in FIG. 7C. Moreover, the various elements of pattern 20 may be triangular, square, pentagonal, hexagonal, elliptical, or any other shape, whether regular or non-regular. Whereas pattern 20 is depicted as being located on an exterior surface of arm region 12*a*, pattern 20 may also be located on an interior surface, as depicted in FIG. 7D. Differences in the thickness of pattern 20 may also impart zones of stretch resistance. With reference to FIG. 7E, pattern 20 is depicted as having a greater thickness in zones 21 and 23 than in zones 22 and 24, thereby imparting greater stretch resistance to zones 21 and 23. Accordingly, a variety of configurations may be utilized for pattern 20.

Figure 8:
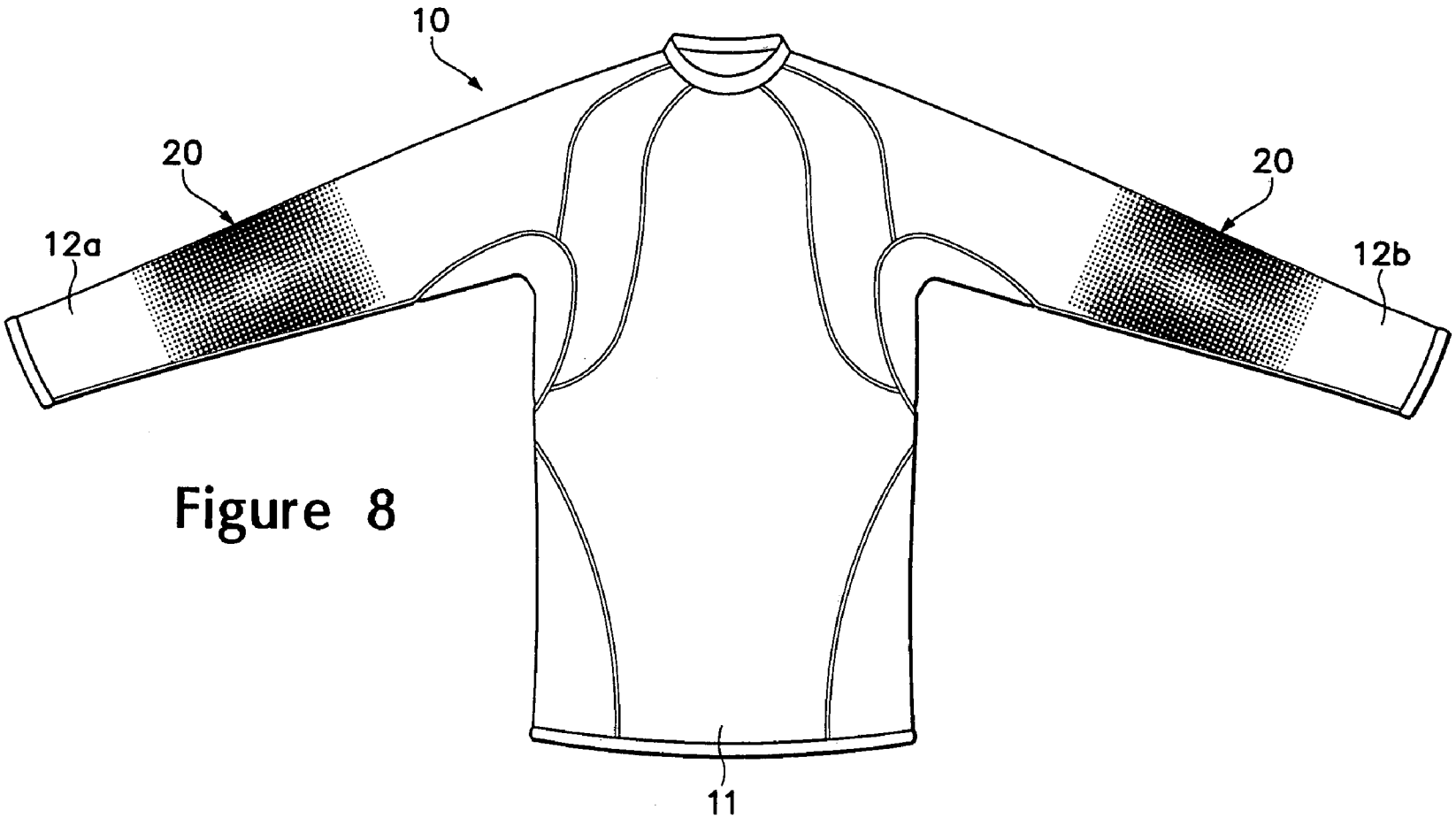
FIG. 8 is a front elevational view of a second article of apparel in accordance with aspects of the present invention.

In circumstances where apparel 10 will be worn by an individual with a left arm as the throwing arm, pattern 20 may be applied to arm region 12*b*. In order to provide apparel 10 with ambidextrous qualities, both arm regions 12*a* and 12*b* may include patterns 20, as depicted in FIG. 8. This configuration may also be beneficial in athletic activities where both arms are utilized in a manner where protection for the elbow joint may be beneficial.

Figure 9:
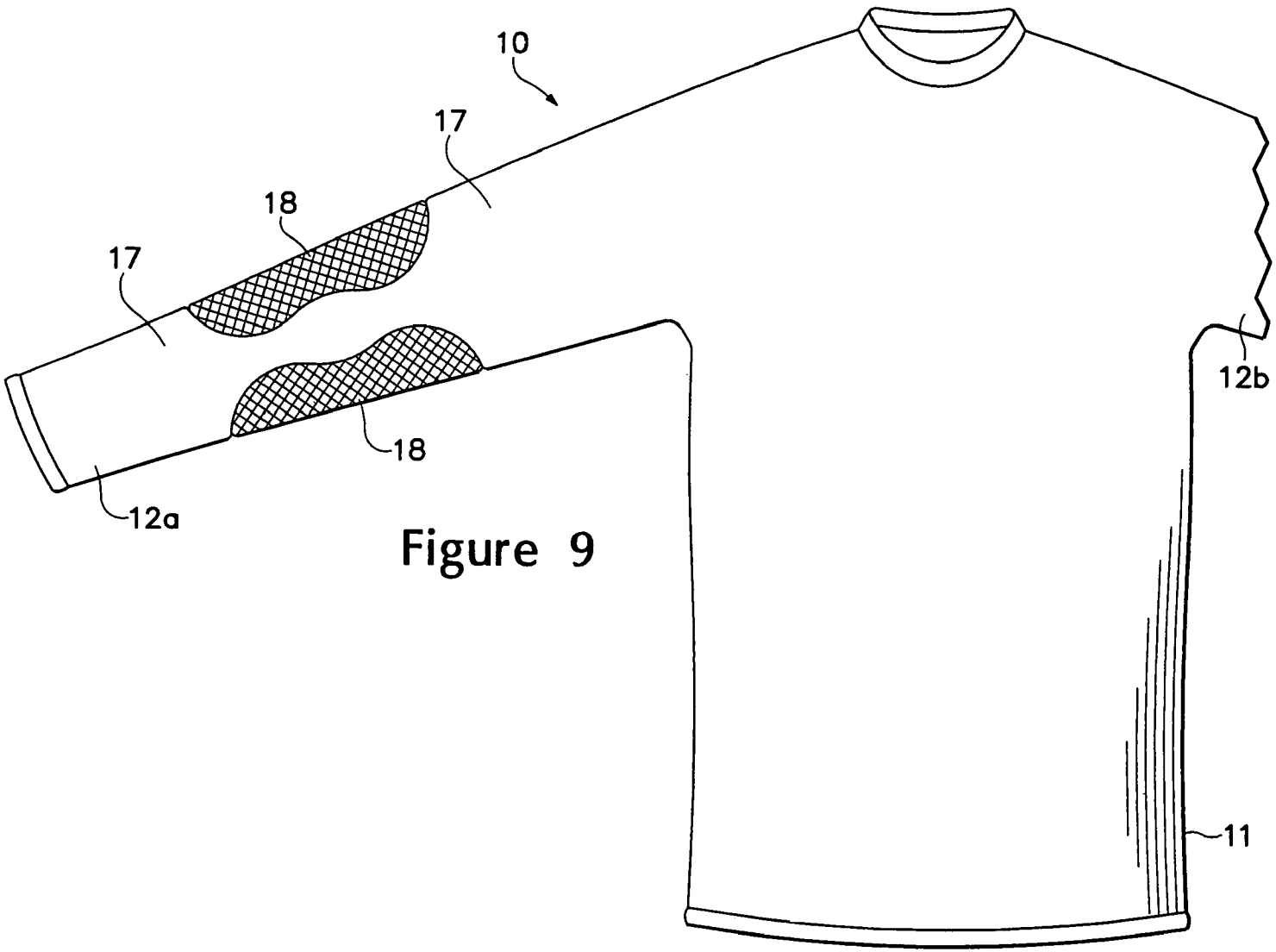
FIG. 9 is a front elevational view of a third article of apparel in accordance with aspects of the present invention.

Applying a material that forms pattern 20 is one manner in which zonal stretch resistance may be achieved. As an alternative, in embodiments where the textile material of arm region 12*a* is formed from polymer threads, material element 14 may be melted in the configuration of pattern 20 to impart zones of stretch resistance. Furthermore, differences in the type of knit utilized around the elbow portion of arm region 12*a* may be utilized to impart zones of stretch resistance. With reference to FIG. 9, arm region 12*a* of apparel 10 is primarily formed from a first knit type 17 and areas corresponding with zones 21 and 23 are formed from a second knit type 18. In comparison with first knit type 17, second knit type 18 may stretch to a lesser degree upon the application of a tensile force to impart zones of stretch resistant material.

Figure 10:
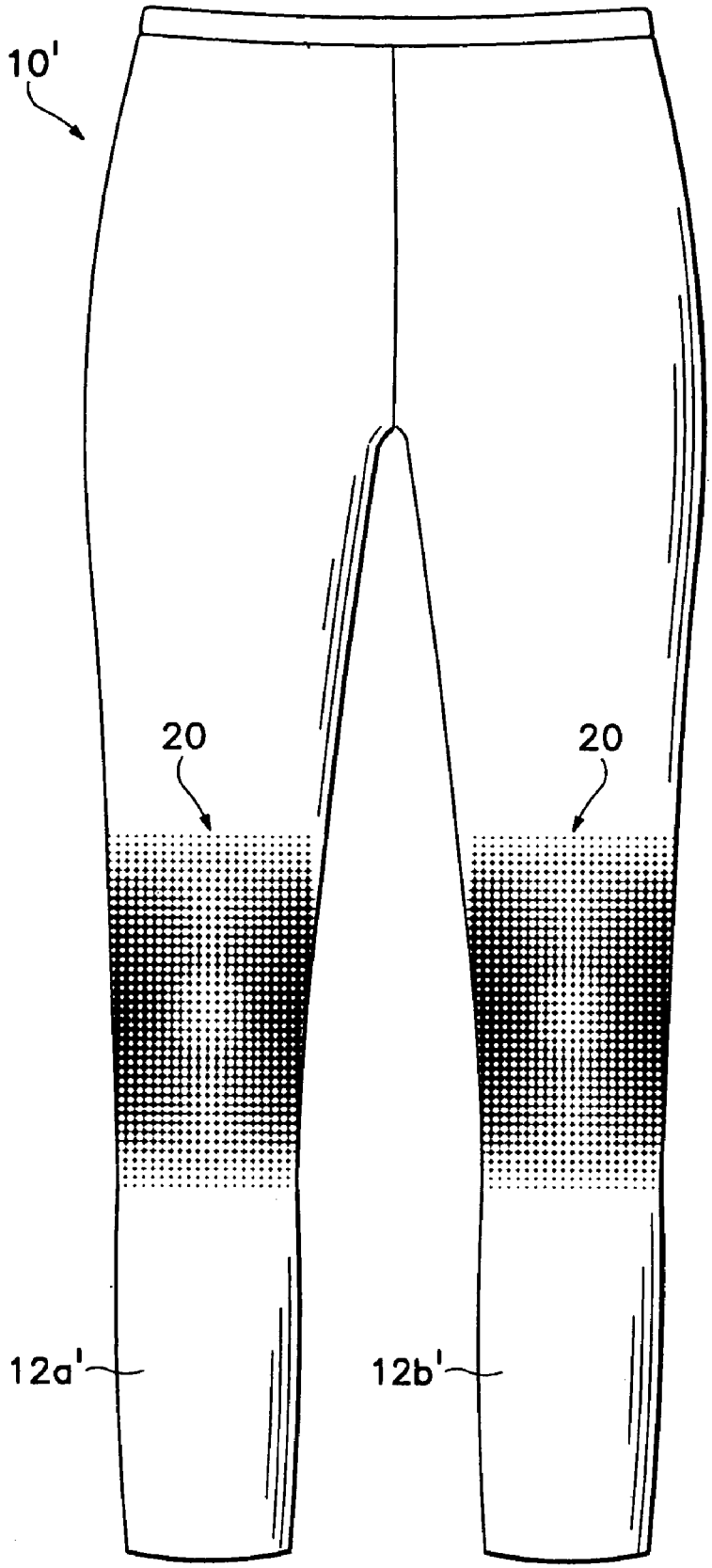
FIG. 10 is a front elevational view of a fourth article of apparel in accordance with aspects of the present invention.

Elbow joints are one example of areas of the body that may benefit from the zonal stretch resistance of pattern 20. With reference to FIG. 10, an article of apparel 10' having the configuration of a pair of pants is depicted. Apparel 10' includes a pair of leg regions 12*a*' and 12*b*' that each include pattern 20 in the knee portions, thereby providing zonal stretch resistance to the knee joints. Other joints, such as the shoulder joints, wrist joints, hip joints, and ankles, for example, may also benefit from structures such as pattern 20 that impart zonal stretch resistance.

The elbow portion of arm region 12*a* and the knee portions of leg regions 12*a*' and 12*b*' form structures for receiving limbs of the individual. Although arm region 12*a* and leg regions 12*a*' and 12*b*' may taper (as is conventional with some articles of apparel), arm region 12*a* and leg regions 12*a*' and 12*b*' exhibit a generally cylindrical configuration. Applying pattern 20 to these cylindrical portions of arm region 12*a* and leg regions 12*a*' and 12*b*' permits zones of different stretch resistance to extend entirely around the circumference of the cylindrical portions. In some embodiments, however, pattern 20 or similar patterns may be applied to non-cylindrical areas of an article of apparel or may extend only partially around various portions of the apparel. Furthermore, in embodiments where pattern 20 or a similar pattern are utilized to impart a unique aesthetic to apparel, pattern 20 may be placed in any practical portion of the apparel.

The textile materials forming arm regions 12*a* and 12*b* may be identical, with the exception of the presence of pattern 20. Following a warm-up or during innings where the pitcher is in a dugout, a pitcher may be concerned with keeping the throwing arm warm so as to keep the throwing arm prepared for pitching. In order to assist with keeping the throwing arm warm, arm region 12*a* may be formed from a material that imparts greater thermal insulation properties than arm region 12*b*. Accordingly, the combination of pattern 20 and a material that imparts enhanced thermal retention may be beneficial.

The invention is disclosed above and in the accompanying drawings with reference to a variety of embodiments. The purpose served by the disclosure, however, is to provide an example of the various features and concepts related to aspects of the invention, not to limit the scope of aspects of the invention. One skilled in the relevant art will recognize that numerous variations and modifications may be made to the embodiments described above without departing from the scope of the invention, as defined by the appended claims.

That which is claimed is:

1. An article of apparel comprising a torso region and a pair of arm regions, at least one of the arm regions having an elbow portion for extending around an elbow joint of a wearer, the elbow portion including:

a pair of first areas oriented substantially parallel to a plane of bending of the elbow joint and located on opposite sides of the elbow portion, the first areas having a first degree of stretch resistance in a direction extending around the elbow portion; and a pair of second areas oriented substantially perpendicular to the plane of bending of the elbow joint and located on opposite sides of the elbow portion, the second areas having a second degree of stretch resistance in the direction extending around the elbow portion, the first degree of stretch resistance being less than the second degree of stretch resistance, wherein a polymer material is secured to the elbow portion, the polymer material defining a plurality of apertures in the pair of first areas, a size of the apertures increases as a position of the apertures approaches the second areas, and the polymer material being a plurality of discrete elements in the second areas, and wherein a size of the elements increases as a position of the elements approaches the first areas.

2. The article of apparel recited in claim 1, wherein the polymer material is printed onto a textile material forming the elbow portion.

3. The article of apparel recited in claim 1, wherein a stripe extends through the elbow region and is oriented substantially parallel to the plane of bending of the elbow joint.

4. The article of apparel recited in claim 1, wherein the elbow portion is formed from a textile, the textile having a first knit type in the first areas, and the textile having a second knit type in the second areas.

5. The article of apparel recited in claim 1, wherein a material forming a first of the arm regions has greater insulative properties than a material forming a second of the arm regions, the elbow portion being a part of the first of the arm regions.

* * * * *

UNITED STATES PATENT AND TRADEMARK OFFICE

CERTIFICATE OF CORRECTION

PATENT NO. : 7,636,950 B2
APPLICATION NO. : 11/241793
DATED : December 29, 2009
INVENTOR(S) : Melhart et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1023 days.

Signed and Sealed this

Ninth Day of November, 2010

David J. Kappos

David J. Kappos
*Director of the United States Patent and Trademark Office*